US011008204B2

(12) United States Patent
Nishino et al.

(10) Patent No.: US 11,008,204 B2
(45) Date of Patent: May 18, 2021

(54) FILLING VALVE AND LIQUID FILLING METHOD

(71) Applicant: SHIBUYA CORPORATION, Ishikawa (JP)

(72) Inventors: Yukinobu Nishino, Ishikawa (JP); Shinya Kamori, Ishikawa (JP); Shunya Ota, Ishikawa (JP); Yuichi Yonemura, Ishikawa (JP); Taro Kitayama, Ishikawa (JP); Katsunori Tanikawa, Ishikawa (JP)

(73) Assignee: SHIBUYA CORPORATION, Ishikawa (JP)

( * ) Notice: Subject to any disclaimer, the term of this patent is extended or adjusted under 35 U.S.C. 154(b) by 0 days.

(21) Appl. No.: 16/198,011

(22) Filed: Nov. 21, 2018

(65) Prior Publication Data

US 2019/0152754 A1 May 23, 2019

(30) Foreign Application Priority Data

Nov. 22, 2017 (JP) ..... JP2017-225153

(51) Int. Cl.
*B67C 3/26* (2006.01)
*B67C 3/28* (2006.01)
*B67D 1/00* (2006.01)

(52) U.S. Cl.
CPC ..... *B67C 3/26* (2013.01); *B67C 3/281* (2013.01); *B67D 1/0081* (2013.01); *B67C 2003/268* (2013.01); *B67C 2003/2677* (2013.01)

(58) Field of Classification Search
CPC ... B67C 3/26; B67C 3/281; B67C 2003/2677; B67C 2003/268; B67D 1/0081
See application file for complete search history.

(56) References Cited

U.S. PATENT DOCUMENTS

2003/0150517 A1* 8/2003 Decarne ..... B67C 3/26 141/286
2011/0303324 A1 12/2011 Mauro et al.
(Continued)

FOREIGN PATENT DOCUMENTS

DE 24 28 553 A1 2/1975
DE 94 16 912 U1 11/1995
(Continued)

OTHER PUBLICATIONS

Extended European Search Report dated Apr. 30, 2019 in European Patent Application No. 18207777.6.

*Primary Examiner* — Jason K Niesz
(74) *Attorney, Agent, or Firm* — Greenblum & Bernstein, P.L.C.

(57) ABSTRACT

A filling valve for filling liquid into a bottle is provided that comprises a nozzle having an outlet on its bottom end and a seat on its interior surface, a stem arranged inside the nozzle and having a plug provided on its outer periphery, a helical vane provided on the outer periphery of the stem for inducing a spiral flow, and a bevel with expanding diameter in the downward direction is provided at the bottom end of the stem. The filling valve is closed when the stem descends and the plug makes contact with the seat. The filling valve is opened when the stem ascends and the plug separates from the seat. The bevel is extended below the outlet when the plug is opened. The liquid revolved via the helical vane and ejected from the outlet is spread by the bevel toward a bottle finish or neck.

2 Claims, 2 Drawing Sheets

(56) References Cited

U.S. PATENT DOCUMENTS

| | | | | |
|---|---|---|---|---|
| 2014/0366982 | A1* | 12/2014 | Clusserath | B67C 3/26 141/104 |
| 2016/0194189 | A1 | 7/2016 | Zoni et al. | |
| 2017/0369297 | A1 | 12/2017 | Zoni et al. | |

FOREIGN PATENT DOCUMENTS

| | | | |
|---|---|---|---|
| FR | 2 020 667 | A1 | 7/1970 |
| JP | 49-40677 | | 11/1974 |
| JP | 2001-097487 | A | 4/2001 |
| JP | 4008574 | | 9/2007 |
| WO | 2010/097730 | A1 | 9/2010 |
| WO | 2014/102075 | A1 | 7/2014 |

* cited by examiner

FILLING VALVE AND LIQUID FILLING METHOD

BACKGROUND OF THE INVENTION

1. Field of the Invention

The present invention relates to a filling valve and a liquid filling method for filling liquid into a vessel having a cylindrical portion with an opening provided on the top face, a diameter expansion portion connected to the cylindrical portion, and a body portion connected to the diameter expansion portion.

2. Description of the Related Art

When liquid is rapidly poured into a vessel through a filling valve of a filling machine that continuously fills the liquid into the vessel, the liquid may spill out from a vessel opening due to its effervescence. Therefore, as for a filling valve for filling an effervescent carbonated beverage, there is known a valve that is provided with a spreader around the tip portion of a vent tube that is inserted into the vessel. The carbonated beverage, which flows down the filling valve, is radially spread outward by the spreader and flows down along an inner surface of the vessel and in turn the effervescence is prevented. See Japanese Patent Publication No. 4008574. On the other hand, there is also known a design providing helically inclined revolution vanes about a valve plug for creating a spiral flow instead of adopting the spreader for preventing the effervescence. See Japanese Examined Patent Publication No. 49-040677.

SUMMARY OF THE INVENTION

When effervescence is prevented by letting the liquid flow along the inner surface of the vessel using the spreader as disclosed in Japanese Patent Publication No. 4008574, the position and the shape of the spreader need to be changed in accordance with the shape of the inner surface of the vessel. Namely, according to the features disclosed in Japanese Patent Publication No. 4008574, one needs to adjust the position of the spreader or change the spreader and/or a vent tube corresponding to the shape of the vessel.

On the other hand, when using a spiral flow generated by the helical vanes as discussed in Japanese Examined Patent Publication No. 49-040677, a spreader is unnecessary because the liquid that flows into the vessel flows down along the inner surface of the vessel by its centrifugal force. Therefore, neither of the position adjustment nor the alteration of the spreader or the vent tube is required. However, in the case of applying the helical vanes, immediately after the filling valve is opened the flow velocity is insufficient for generating a spiral flow capable of inducing a sufficient centrifugal force for the ejected liquid to reach the inner surface of the vessel body. This is especially problematic when filling liquid into a vessel with a steeply expanding diameter at the diameter-expansion portion compared to a vessel with a gradually expanding diameter, such as a beer bottle. Namely, the liquid that flows into the vessel directly falls down toward the base without flowing down along the inner surface of the vessel and in turn the effervescence is generated.

One aspect of the present invention is to prevent effervescence of a filling liquid in a simple manner, regardless of the shape of a vessel, when filling the liquid into a vessel having a cylindrical portion with an opening provided on the top face, a diameter expansion portion connected to the cylindrical portion, and a body portion connected to the diameter expansion portion.

According to a primary aspect of the present invention, a filling valve for filling liquid into a vessel having a cylindrical portion with an opening provided on the top face, a diameter expansion portion connected to the cylindrical portion, and a body portion connected to the diameter expansion portion is provided. The filling valve comprises a nozzle having an outlet on its bottom end and a seat on its interior surface; a stem having a plug provided on its outer periphery that comes into contact with the seat, the stem being able to form a liquid flow passage between the plug and the interior surface of the nozzle, and an actuator for opening and closing the plug by raising and lowering the stem. The stem is provided with a helical vane on its outer periphery that creates a force inducing a spiral flow in the liquid passing through the liquid flow passage, and a bottom end portion of the stem is provided with a bevel with a radially expanding diameter in the downward direction. When the plug is opened, the bevel is extended below the outlet and positioned inside the cylindrical portion of the vessel and a liquid flow revolving via the helical vane is guided to an inner surface of the cylindrical portion of the vessel by the bevel.

According to another aspect of the present invention, a liquid filling method for filling liquid into a vessel having a cylindrical portion with an opening provided on the top face, a diameter expansion portion connected to the cylindrical portion, and a body portion connected to the diameter expansion portion. The method comprises flowing the liquid into the opening of the vessel after applying a force for inducing a spiral flow, radially spreading the spiral flow inside the cylindrical portion of the vessel, and guiding the liquid to the inner surface of the cylindrical portion of the vessel so that the liquid spirally flows along the inner surface.

BRIEF DESCRIPTION OF THE DRAWINGS

The objects and advantages of the present invention will be better understood from the following description with references to the accompanying drawings in which.

DESCRIPTION OF THE PREFERRED EMBODIMENTS

Figure 1:
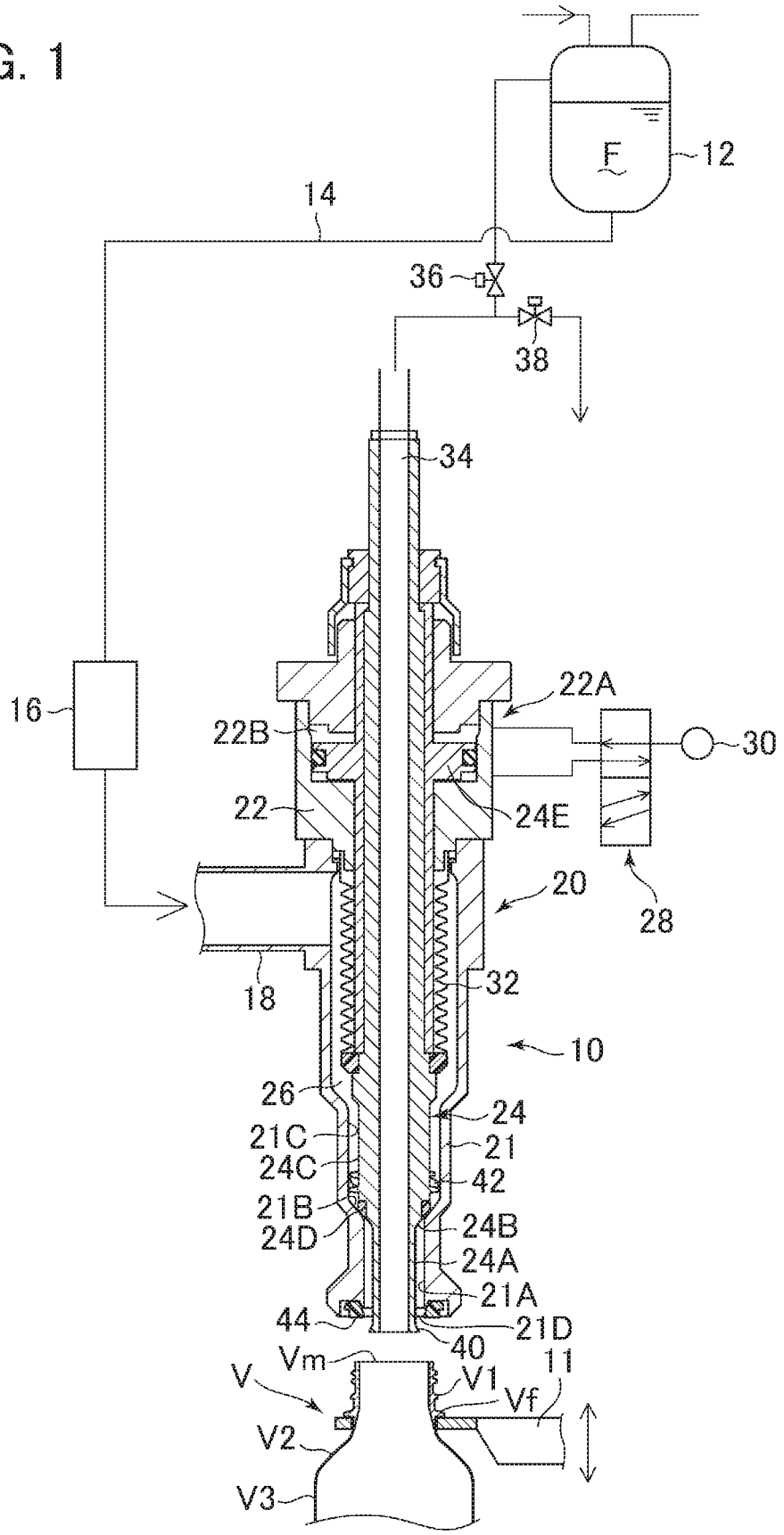
FIG. 1 is a side elevational view schematically illustrating a configuration of a filling valve of an embodiment of the present invention.

The present invention is described below with references to the embodiments shown in the drawings. FIG. 1 is a side elevational view schematically illustrating a configuration of a filling valve of an embodiment of the present invention.

The filing valve 10 of the present embodiment fills effervescent liquid F, such as carbonated beverage, into a vessel V with a cylindrical portion V1 (e.g., a finish and a neck of a bottle) with an opening Vm provided on the top end, a diameter expansion portion V2 (e.g., a shoulder) connected to the cylindrical portion V1, and a body portion V3 connected to the diameter expansion portion V2. An example of the vessel is a PET bottle that has inner diameters that expand comparatively steeply from the opening Vm and the cylindrical portion V1 to the body portion V3 through the diameter expansion portion V2. Incidentally, in a liquid filling operation, the vessel V is supported by a gripper 11 that grips the cylindrical portion V1 beneath a collar Vf provided on the periphery of the cylindrical portion V1.

The filling liquid F is stored in a liquid-storage tank 12. Carbon dioxide compressed gas is enclosed in the headspace inside the liquid-storage tank 12. When filling a carbonated beverage, compressed carbon dioxide gas is enclosed in the headspace; however, uncompressed air exists in the headspace when the filling liquid F is not a carbonated beverage.

One end of a filling-liquid supply pipe 14 is connected to a bottom of the liquid-storage tank 12. The other end of the filling-liquid supply pipe 14 is connected to a filling-liquid inlet 18 of the filling valve 10 through a flowmeter 16. The filling valve 10 includes a tubular shell member 20 and a valve stem 24 liftably inserted inside the shell member 20. The shell member 20 includes a lower shell member 21 and an upper shell member 22. The lower shell member 21 is used as a filling nozzle and the upper shell member 22 drives an open/close operation of the filling valve 10. The filling-liquid inlet 18 is provided on the upper side wall of the lower shell member 21.

Below the filling-liquid inlet 18 and between the valve stem 24 and the lower shell member 21 is provided a vertically long cylindrical flow passage 26, where the filling liquid F flows about the valve stem 24. The bottom end of the valve stem 24 projects below the bottom end of the lower shell member 21.

In the present embodiment, the valve stem 24 is configured as a tubular member so that the inner tube of the valve stem 24 functions as a vent tube exhausting gas from the vessel V during a filling operation. A lower section of the valve stem 24 inserted inside the lower shell member 21 includes three segments with different dimensions: A small-diameter segment 24A configuring the lower end of the valve stem 24, a large-diameter segment 24C positioned above the small-diameter segment 24A, and a diameter-reducing segment 24B connecting the small-diameter segment 24A and the large-diameter segment 24C. Inside the lower shell member 21, a small-diameter shell segment 21A, a diameter-reducing shell segment 21B and a large-diameter shell segment 21C are provided to form a gap configured so that the flow passage 26 matches the shape of the valve stem 24. The bottom opening of the small-diameter shell segment 21A functions as an outlet 21D of the nozzle.

The valve stem 24 can move up and down inside the shell member 21 and the diameter-reducing segment 24B is configured to function as a plug of the valve and the diameter-reducing shell segment 21B as a seat of the valve. Namely, the inner diameter of the diameter-reducing shell segment 21A is smaller than the outer diameter of the large-diameter segment 24C. When the valve stem 24 descends, the diameter-reducing segment 24B makes contact with the diameter-reducing shell segment 21B, and in turn an annular seal member 24D (e.g., O-ring) provided around the bottom end of the large-diameter segment 24C or on the diameter-reducing segment 24B is pressed against the diameter-reducing shell segment 21B so that the flow passage 26 is closed hermetically.

The up-and-down movement of the valve stem 24 is carried out by a lifting mechanism 22A provided inside the upper shell member 22. The lifting mechanism 22A, for example, includes a cylinder 22B formed inside the upper shell member 22 and a piston 24E that is fitted in the cylinder 22B. The valve stem 24 is driven by taking air in and out from an upper chamber and a lower chamber that are hermetically separated in the vertical direction by the piston 24E. Incidentally, the operation of taking air in and out of the chambers defined in the cylinder 22B is performed by a selector valve 28 connected to an air pressure source 30.

In order to separate the flow passage 26 from the drive portion of the valve stem 24, tubular bellows 32, which are vertically stretchable in response to a vertical movement of the valve stem 24, are arranged around the valve stem 24. Further, the bottom end of the bellows 32 is hermetically attached to the periphery of the valve stem 24 inside the lower shell member 21 and the upper end of the bellows 32 is hermetically attached to the bottom end of the upper shell member 22. Thereby, the flow passage 26 is separated by the bellows 32 from the upper shell member 22 and the sliding portion of the valve stem 24.

A hollow 34 formed inside the valve stem 24 can be connected to the headspace of the liquid-storage tank 12 via a counter valve 36 and releasable to the open air via a snifting valve 38. Further, at the bottom end of the valve stem 24, a flare portion 40 is provided with a radially expanding diameter in the downward direction. Thereby, a bevel 40*a* is formed around the periphery of the bottom end of the small-diameter segment 24A. Further, a plurality of helical vanes 42 is provided on the periphery of the large-diameter segment 24C in the vicinity of the small-diameter segment 24B above the seal member 24D. The outer dimensions of helical vanes 42 are approximately the same as the inner diameter of the large-diameter shell segment 21C of the lower shell member 21. Namely, helical flow passages are defined by the outer peripheral surface of the large-diameter segment 24C, helical vanes 42 and the inner peripheral surface of the large-diameter shell segment 21C. Further, an annular seal member 44 is provided on the outer circumference of the outlet 21D at the bottom of the lower shell member 21. The seal member 44 is pressed against the opening Vm of the vessel V and in turn hermetically seals the opening Vm of the vessel V during the filling operation.

Figure 2:
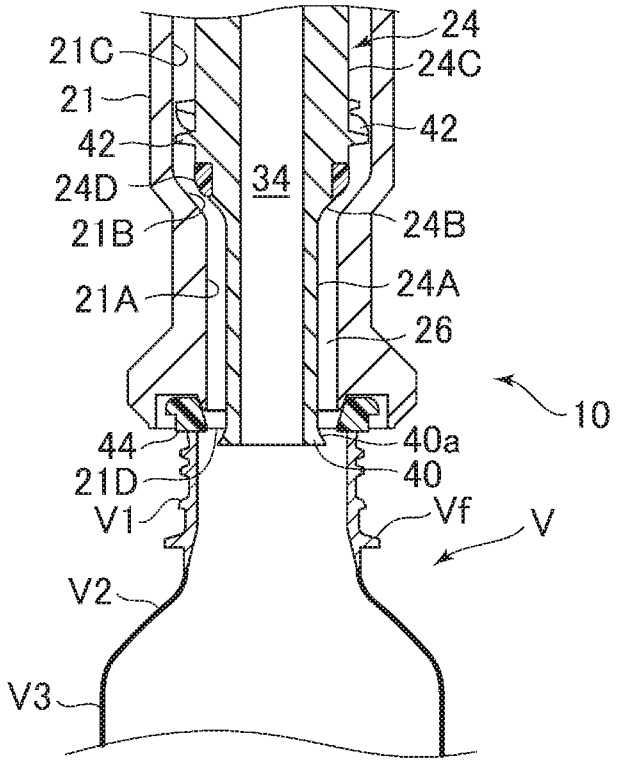
FIG. 2 is an enlarged sectional view of the filling valve around the tip end.
Figure 3:
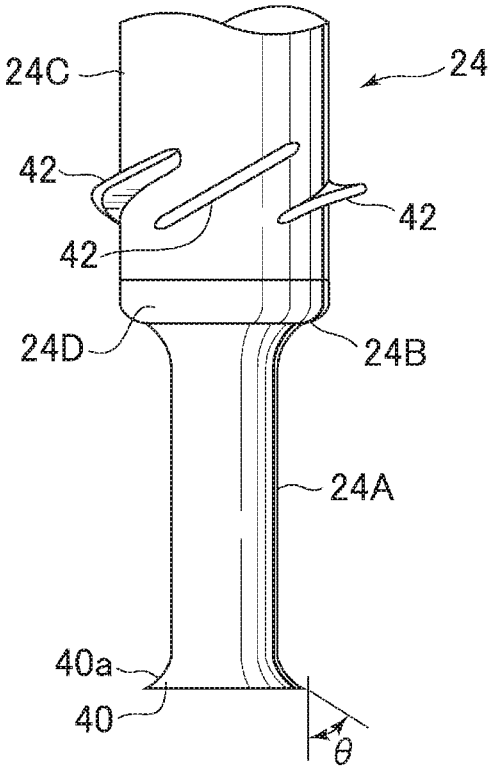
FIG. 3 is an enlarged sectional view of the valve stem around the tip end.

With reference to FIGS. 1-3, a carbonated beverage filling operation performed by the filling valve 10 of the present embodiment is explained. FIG. 2 is an enlarged sectional view of the filling valve 10 around the tip end. In FIG. 2, the vessel V abuts against the filling valve 10 and the valve is opened. FIG. 3 is an enlarged sectional view of the valve stem 24 around the tip end.

In FIG. 1, the valve stem 24 is lowered by the lifting mechanism 22A and thereby the filling valve 10 is closed. FIG. 2 illustrates the state in which the filling liquid F is filled into the vessel V via the filling valve 10. Namely, the opening Vm of the vessel V is pressed against the seal member 44 of the filling valve 10, the valve stem 24 is lifted by the lifting mechanism 22A and thereby, the small-diameter segment 24B is separated from the diameter-reducing shell segment 21B and the valve is opened.

When the valve is opened, the flare portion 40 provided at the tip end of the valve stem 24 protrudes below the outlet 21D formed on the bottom end of the lower shell member 21. Thereby, the flare portion 40 is positioned inside the cylindrical portion V1 of the vessel V. In the present embodiment, a cone angle at the periphery of the flare portion 40 that is defined by an angle θ between a generating line (a tangent line in a radial direction at the periphery of the flare portion 40) and the downward direction (a direction parallel to the axis of the small-diameter segment 24A) is set to about 60 degrees. Incidentally, when the valve stem 24 is lifted to open the valve during the filling operation, the position where the bevel 40*a* starts to radially extend from the cylindrical surface of the small-diameter segment 24A is positioned about the same level with the top end of the opening Vm of the vessel V.

Immediately before the beginning of the filling operation, the filling valve 10 is closed as illustrated in FIG. 1. Namely, the valve stem 24 is lowered by the lifting mechanism 22A and the seal member 24D of the small-diameter segment 24B is pressed against the small-diameter shell segment 21B whereby closing the flow passage 26.

When the filling operation is started, the gripper 11 that grips the vessel V is lifted and as shown in FIG. 2, the top end of the vessel V provided with the opening Vm is pressed against the seal member 44 that is provided on the bottom end of the lower shell member 21 so that the inside of the vessel V is hermetically isolated from the ambient atmosphere. The counter valve 36 is then opened while the snifting valve 38 is closed, thereby connecting the interior of the vessel V to the headspace of the liquid-storage tank 12 via the hollow 34 of the valve stem 24. When the pressure inside the vessel V becomes the same as the pressure of the headspace of the liquid-storage tank 12 by releasing the counter valve 36, the selector valve 28 is switched on and the valve stem 24 is lifted by the lifting mechanism 22A and in turn the filling valve 10 is opened. Namely, the seal member 24D that is provided on the small-diameter segment 24B configuring the plug, departs from the small-diameter shell segment 21 configuring the seat and the flow passage 26 is opened.

When the filling valve 10 is opened, the filling liquid F starts to flow into the liquid passage 26 via the liquid-filling inlet 18 and flows down the liquid passage 26. As the valve stem 24 reaches the upper limit position by the lifting mechanism 22A, the flare portion 40 at the tip end of the valve stem 24 is positioned where the top end of the bevel 40*a* corresponds to the level of the outlet 21D, as illustrated in FIG. 2. The filling liquid F that flows down the flow passage 26 is given a tangential flow component by the helical flow passage defined by the helical vanes 42. Namely, the filling liquid F spirally flows down inside the flow passage 26 defined by the outer surface of the small-diameter segment 24B of the valve stem 24 and inner surface of the small-diameter shell segment 21B.

As the filling liquid F reaches the outlet 21D at the bottom end of the filling valve 10, the filling liquid F is radially sprinkled outward from the center of the valve stem 24 by a tangential velocity component due to the centrifugal force of the revolving flow and by the bevel 40*a* extending radially outward. Thereby, the filling liquid F is sprinkled to the inner surface of the cylindrical portion V1 of the vessel V. While the centrifugal force of the helical flow generated by the helical vanes 42 is weak in the beginning of the filling operation, the sprinkled filling liquid F can reach the inner surface of the cylindrical portion V1 by a synergistic effect of the centrifugal force and the flare portion 40*a*. When the helical flow is sufficiently developed, the sprinkled filling liquid F reaches the inner surface of the cylindrical portion V1 mainly by the effect of the centrifugal force due to the revolving flow.

The amount of the filling liquid F supplied to the filling valve 10 is monitored by the flowmeter 16. When the amount of the filling liquid F supplied to the filling valve 10 reaches a predetermined amount, the selector valve 28 is switched on and the lifting mechanism 22A is driven. Thereby the valve stem 24 descends and the filling valve is closed by abutting the seal member 24D of the small-diameter segment 24B to the small-diameter shell segment 21B. The counter valve 36 is then closed while opening the snifting valve 38 so that the interior of the vessel V is released to the atmospheric pressure. Further, the vessel V is lowered by the gripper 11 and the opening Vm of the vessel V is released from the filling valve 10.

The above explanation is valid for the filling operation of the filling valve when filling a carbonated beverage. However, when filling a beverage other than a carbonated beverage the filling operation is carried out under the conditions that the counter valve is regularly opened and the snifting vale is regularly closed.

As described above and according to the present embodiment, even when filling liquid into a vessel having the cylindrical portion with the opening provided on the top face, the diameter expansion portion connected to the cylindrical portion, and the body portion connected to the diameter expansion portion, the synergistic effect of the helical flow and the bevel prevents the effervescence induced by drops that may be generated in the beginning of the filling operation (i.e., when the revolving flow is weak) by simply positioning the flare portion inside the cylindrical portion of the vessel.

Incidentally, as for a vessel like a PET bottle, the dimension of the cylindrical portion does not change much even though the overall dimensions and the shape of the bottle changes. Therefore, the effervescence can be prevented for various types of PET bottles by one common flare portion even when the protruding amount of the valve stem and the cone angle of the flare portion are determined from general dimensions of the inner diameter of an opening and the height of a cylindrical portion and the outer diameter of a valve stem. Namely, when revolving the filling liquid along the interior surface of the cylindrical portion, the filling liquid spirally expands along the diameter expansion portion so that it flows down along the interior surface of the vessel. Further, according to the present embodiment, the effervescence of the filling liquid is prevented by a quite simple configuration. In contrast to the conventional art, the position adjustment of the spreader with respect to the vessel and alteration of a valve stem are unnecessary.

Incidentally, when the protruding amount of the valve stem from the lower shell member is little and/or the cone angle of the bevel is large, the flow passage narrows and the filling efficiency deteriorates. Further, when the protruding amount of the valve stem from the lower shell member is large, i.e., the bevel is apart from the outlet and/or the cone angle of the bevel is small, the effect of urging the filling liquid toward the interior surface of the cylindrical vessel is mitigated. Therefore, in the present embodiment, a 60-degree bevel is provided from the outlet and a gap between the outer periphery (inner periphery of the annular seal member) of the outlet and the bevel is adjusted so that its sectional area proximate the flow width of the annular flow passage.

Although the embodiment of the present invention has been described herein with reference to the accompanying drawings, obviously many modifications and changes may be made by those skilled in this art without departing from the scope of the invention.

The present disclosure relates to subject matter contained in Japanese Patent Application No. 2017-225153 (filed on Nov. 22, 2017), which is expressly incorporated herein, by reference, in its entirety.

The invention claimed is:

1. A filling valve for filling liquid into a vessel having a cylindrical portion with an opening provided on a top end, a diameter expansion portion where an inner diameter is expanded and that is connected to the cylindrical portion, and a body portion connected to the diameter expansion portion, the filling valve comprising:

a nozzle having an outlet on its bottom end and a seat on its interior surface;

a stem having a plug provided on its outer periphery that comes into contact with the seat and being liftably traversable inside the nozzle, the stem being configured to form a liquid flow passage between the plug and the interior surface of the nozzle;

an actuator to open and close the plug by raising and lowering the stem; and a seal member that makes contact with the opening of the vessel on an outer periphery of the outlet of the nozzle, the stem including a small-diameter segment configuring a lower end, a large-diameter segment positioned above the small-diameter segment, and a diameter-reducing segment connecting the small-diameter segment and the large-diameter segment, inside the nozzle, a small-diameter shell segment of the nozzle, a diameter-reducing shell segment of the nozzle, and a large-diameter shell segment of the nozzle that are adapted to a shape of the stem are arranged from a lower end side to form a flow passage, the diameter-reducing shell segment of the nozzle being configured as the seat, the outlet being formed at a lower end of the small-diameter segment, which is positioned below the diameter-reducing shell segment, the stem also being formed with an opening facing downwards and being configured as a vent tube that evacuates gas from the vessel during the filling, the diameter-reducing segment of the stem being configured as the plug, the large-diameter segment above the diameter-reducing segment being provided with a helical vane on its outer periphery that creates a centrifugal force inducing a spiral flow in the liquid passing through the liquid flow passage, and a bottom end portion of the small-diameter segment being provided with a bevel with a radially expanding diameter in a downward direction that extends down to a bottom end of the stem, when the plug is closed, the entire bevel is positioned lower than the seal member, when the stem is lifted and the plug is opened with the opening of the vessel abutted to the seal member, the bevel is positioned inside the cylindrical portion of the vessel, and a top end of the bevel is positioned at a level of the seal member, and the helical vane revolves a liquid flow to spirally flow down the liquid flow passage between the small-diameter segment of the stem and the small-diameter shell segment of the nozzle and to flow out from the outlet, and in turn, the bevel radially spreads out the spiral flow so that the spiral flow is guided to an inner surface of the cylindrical portion of the vessel by the bevel.

2. The filling valve according to claim 1, wherein the actuator is configured to move the stem based on an amount of the liquid supplied to the filling valve that is monitored by a flowmeter.

* * * * *